US010294557B2

(12) United States Patent
Corquillet et al.

(10) Patent No.: US 10,294,557 B2
(45) **Date of Patent: *May 21, 2019**

(54) METHOD FOR MAKING A STEEL PART OF MULTIPHASE MICROSTRUCTURE

(75) Inventors: Jacques Corquillet, Istres (FR); Jacques Devroc, Arles (FR); Jean-Louis Hochard, Hayange (FR); Jean-Pierre Laurent, Istres (FR); Antoine Moulin, Woippy (FR); Nathalie Romanowski, Rurange les Thionville (FR)

(73) Assignee: ArcelorMittal France, Saint Denis (FR)

( * ) Notice: Subject to any disclaimer, the term of this patent is extended or adjusted under 35 U.S.C. 154(b) by 920 days.

This patent is subject to a terminal disclaimer.

(21) Appl. No.: 13/343,896

(22) Filed: Jan. 5, 2012

(65) Prior Publication Data

US 2012/0211128 A1 Aug. 23, 2012

Related U.S. Application Data

(62) Division of application No. 12/068,533, filed as application No. PCT/FR2006/002135 on Sep. 18, 2006, now Pat. No. 8,114,227.

(30) Foreign Application Priority Data

Sep. 21, 2005 (EP) ..... 05291958

(51) Int. Cl.
*C21D 1/18* (2006.01)
*C21D 7/13* (2006.01)
(Continued)

(52) U.S. Cl.
CPC ..... *C23C 2/26* (2013.01); *C21D 1/185* (2013.01); *C21D 1/673* (2013.01); *C21D 7/13* (2013.01);
(Continued)

(58) Field of Classification Search
CPC ..... C23C 2/26; C22C 38/02; C22C 38/22; C22C 38/28; C22C 38/38; C22C 38/06;
(Continued)

(56) References Cited

U.S. PATENT DOCUMENTS 4,222,796 A 9/1980 Davies
5,531,842 A 7/1996 Koo et al.
(Continued)

FOREIGN PATENT DOCUMENTS

EP 1 013 785 6/2000
FR 2 671 749 7/1992
(Continued)

*Primary Examiner* — Keith Walker
*Assistant Examiner* — John A Hevey
(74) *Attorney, Agent, or Firm* — Davidson, Davidson & Kappel, LLC; Jennifer L. O'Connell; William C. Gehris

(57) ABSTRACT

A steel part having a homogeneous multiphase microstructure in each region of the part, the microstructure containing ferrite, wherein the steel part is obtained by a process involving:

cutting a blank from a strip of steel, having a specified composition;

optionally, the blank undergoes prior cold deformation;

the blank is heated to reach a soak temperature $T_s$ above Ac1 but below Ac3 and held at this soak temperature $T_s$ for a soak time $t_s$ adjusted so that the steel, after the blank has been heated, has an austenite content equal to or greater than 25% by area;

the heated blank is transferred into a forming tool to hot-form the part; and the part is cooled within the tool at a cooling rate V such that the microstructure of the steel, after cooling the part, is a multiphase microstructure containing ferrite and being homogeneous in each region of the part.

25 Claims, 1 Drawing Sheet

(51) Int. Cl.

| | |
|---|---|
| ***C21D 9/46*** | (2006.01) |
| ***C21D 9/48*** | (2006.01) |
| ***C23C 2/26*** | (2006.01) |
| ***C21D 1/673*** | (2006.01) |
| ***C22C 38/02*** | (2006.01) |
| ***C22C 38/06*** | (2006.01) |
| ***C22C 38/22*** | (2006.01) |
| ***C22C 38/28*** | (2006.01) |
| ***C22C 38/38*** | (2006.01) |

(52) U.S. Cl.
CPC ..... *C22C 38/02* (2013.01); *C22C 38/06* (2013.01); *C22C 38/22* (2013.01); *C22C 38/28* (2013.01); *C22C 38/38* (2013.01); *C21D 9/46* (2013.01); *C21D 9/48* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 1/185; C21D 1/673; C21D 7/13; C21D 2211/001; C21D 2211/002; C21D 2211/005; C21D 2211/008; C21D 9/46; C21D 9/48
USPC ..... 148/531, 334, 533, 534, 621, 651, 654
See application file for complete search history.

(56) References Cited

U.S. PATENT DOCUMENTS

| | | | | |
|---|---|---|---|---|
| 6,296,805 | B1 * | 10/2001 | Laurent et al. | 420/104 |
| 6,517,955 | B1 * | 2/2003 | Takada et al. | 428/659 |
| 6,544,354 | B1 * | 4/2003 | Kawano et al. | 148/320 |
| 8,141,230 | B2 | 3/2012 | Brodt et al. | |
| 8,722,203 | B2 * | 5/2014 | Laurent et al. | 428/653 |
| 2001/0042393 | A1 | 11/2001 | Kefferstein et al. | |
| 2003/0047258 | A1 * | 3/2003 | Sakata | C21D 8/0273 148/654 |
| 2004/0159373 | A1 * | 8/2004 | Ikeda et al. | 148/320 |
| 2004/0163439 | A1 | 8/2004 | Arns et al. | |
| 2004/0226635 | A1 * | 11/2004 | Ikeda | C21D 7/13 148/649 |
| 2005/0257862 | A1 * | 11/2005 | Asai | C21D 1/673 148/654 |
| 2014/0120371 | A1 * | 5/2014 | Mbacke et al. | 428/659 |

FOREIGN PATENT DOCUMENTS

| | | |
|---|---|---|
| JP | 59 211533 | 11/1984 |
| JP | 60 43430 | 3/1985 |
| JP | S62286626 A | 12/1987 |
| JP | 09-143612 | 6/1997 |
| JP | 2004160489 | 6/2004 |
| JP | 2005-097725 | 4/2005 |
| RU | 2147040 C1 | 3/2000 |
| RU | 2169786 C2 | 6/2001 |
| WO | 9703215 | 1/1997 |

* cited by examiner

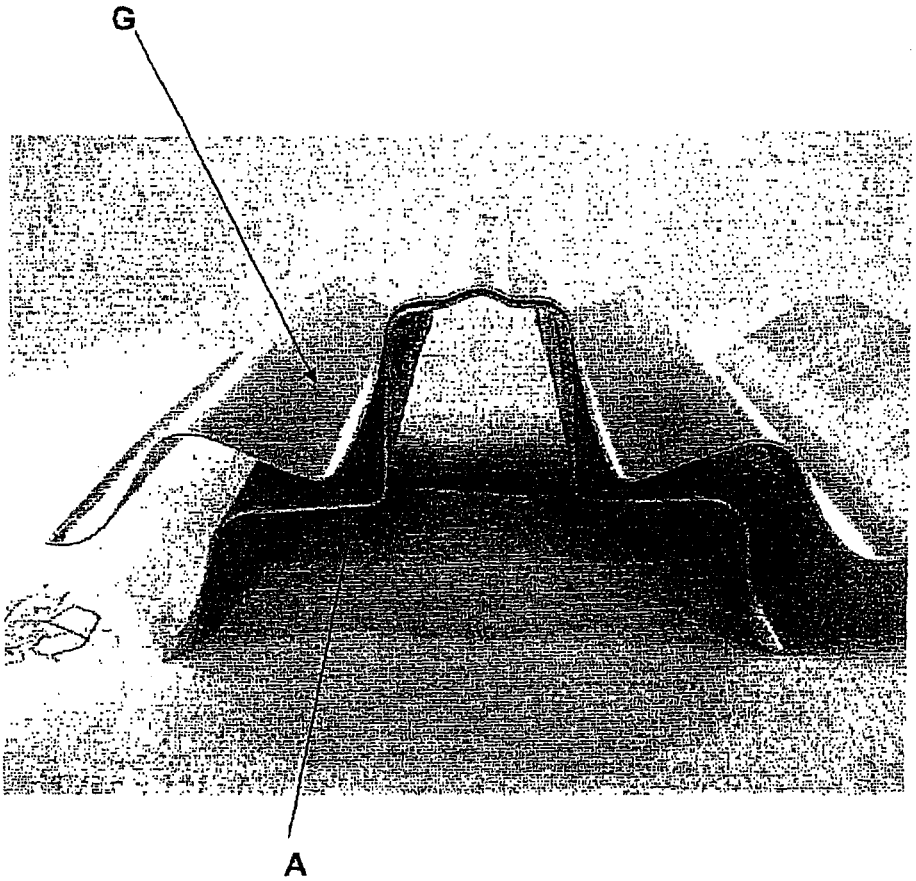
G
A

METHOD FOR MAKING A STEEL PART OF MULTIPHASE MICROSTRUCTURE

CROSS REFERENCE TO RELATED APPLICATIONS

The present application is a Divisional of U.S. application Ser. No. 12/067,533, filed Sep. 2, 2008, now allowed, which was a 371 of PCT/FR2006/002135, filed Sep. 18, 2006, the contents of both of which are hereby incorporated by reference in their entirety.

The present invention relates to a process for manufacturing a part made of steel having a homogeneous multiphase microstructure in each of the regions of said part, and having high mechanical properties.

To meet the requirements of lightening automobile structures, it is known to use either TRIP steels (the term TRIP meaning transformation induced plasticity) or dual-phase steels which combine a very high tensile strength with very high deformability. TRIP steels have a microstructure composed of ferrite, residual austenite and optionally bainite and martensite, which allows them to reach tensile strengths ranging from 600 to 1000 MPa. Dual-phase steels have a microstructure composed of ferrite and martensite, which allows them to reach tensile strengths ranging from 400 MPa to more than 1200 MPa.

These types of steels are widely used for producing energy-absorbing parts, for example structural and safety parts such as longitudinal members, cross-members and reinforcements.

To manufacture such parts, it is usual for a blank, cut from a cold-rolled strip of dual-phase steel or TRIP steel, to undergo a cold-forming process, for example deep-drawing between tools. However, the development of parts made of dual-phase steel or TRIP steel is limited owing to the difficulty of controlling the springback of the formed part, which springback is greater the higher the tensile strength $R_m$ of the steel. This is because, to alleviate the effect of the springback, automobile manufacturers are obliged to incorporate this parameter into the design of new parts, thereby, on the one hand, requiring numerous developments and, on the other hand, limiting the range of shapes that can be produced.

Furthermore, in the case of large deformation, the microstructure of the steel is no longer homogeneous in each of the regions of the part, and the behavior of the part in service is difficult to predict. For example, when cold-forming a sheet of TRIP steel, the residual austenite is transformed to martensite under the effect of the deformation. Since the deformation is not homogeneous throughout the part, certain regions of the part will still contain residual austenite that has not been transformed to martensite, which regions will consequently have a high residual ductility, whereas other regions of the part that have undergone large deformation will have a ferritic-martensitic structure, possibly containing bainite, which is of low ductility.

The object of the present invention is therefore to remedy the aforementioned drawbacks and to propose a process for manufacturing a part made of steel comprising ferrite and having a multiphase microstructure that is homogeneous in each of the regions of said part, and not exhibiting springback after a blank, obtained from a strip of steel whose composition is typical of that of steels having a multiphase microstructure, has been formed.

For this purpose, a first subject of the invention is a process for manufacturing a part made of steel having a multiphase microstructure, said microstructure comprising ferrite and being homogeneous in each of the regions of said part, which process comprises the steps consisting in:

cutting a blank from a strip of steel, the composition of which consists, in % by weight, of:

$0.01 \leq C \leq 0.50\%$
$0.50 \leq Mn \leq 3.0\%$
$0.001 \leq Si \leq 3.0\%$
$0.005 \leq Al \leq 3.0\%$
$Mo \leq 1.0\%$
$Cr \leq 1.5\%$
$P \leq 0.10\%$
$Ti \leq 0.20\%$
$V \leq 1.0\%$ and, optionally, one or more elements such as:

$Ni \leq 2.0\%$
$Cu \leq 2.0\%$
$S \leq 0.05\%$
$Nb \leq 0.15\%$, the balance of the composition being iron and impurities resulting from the smelting;

optionally, said blank undergoes prior cold deformation;

said blank is heated so as to reach a soak temperature $T_s$ above Ac1 but below Ac3 and held at this soak temperature $T_s$ for a soak time $t_s$ adjusted so that the steel, after the blank has been heated, has an austenite content equal to or greater than 25% by area;

said heated blank is transferred into a forming tool so as to hot-form said part; and the part is cooled within the tool at a cooling rate V such that the microstructure of the steel, after the part has been cooled, is a multiphase microstructure, said microstructure comprising ferrite and being homogeneous in each of the regions of said part.

To determine the % contents by area of the various phases present in a microstructure (ferrite phase, austenite phase, etc.), the area of the various phases is measured in a section produced along a plane perpendicular to the plane of the strip (this plane may be parallel to the rolling direction or parallel in the cross direction of the rolling). The various phases sought are revealed by suitable chemical etching according to their nature.

Within the context of the present invention, the term "forming tool" is understood to mean any tool that allows a part to be obtained from a blank, such as for example a deep-drawing tool. This therefore excludes cold-rolling or hot-rolling tools.

The inventors have demonstrated that, by heating the blank to a soak temperature $T_s$ between Ac1 and Ac3, a multiphase microstructure comprising ferrite exhibiting homogeneous mechanical properties, irrespective of the cooling rate of the blank between the tools, is obtained provided that the cooling rate is high enough. The homogeneity of the mechanical properties is defined within the context of the invention by a dispersion in the tensile strength $R_m$ within a cooling rate range varying from 10 to 100° C./s of less than 25%. This is because the inventors have found that, by subjecting the blank to a heat treatment in the intercritical range, then $R_m$ (100° C./s)-$R_m$ (10° C./s)/$R_m$ (100° C./s) is less than 0.25, $R_m$ (100° C./s) being the tensile strength of the part cooled at 100° C./s and $R_m$ (10° C./s) being the tensile strength of the part cooled at 10° C./s.

The second subject of the invention is a part made of steel, comprising ferrite and having a multiphase microstructure that is homogeneous in each of the regions of said part, which may be obtained by said process.

Finally, the third subject of the invention is a land motor vehicle that includes said part.

The features and advantages of the present invention will become more clearly apparent over the course of the following description, given by way of nonlimiting example, with reference to the appended FIG. 1 in which:

FIG. 1 is a photograph of a part obtained by cold-forming (reference G) and of a part obtained by hot-forming (reference A).

The process according to the invention consists in hot-forming, within a certain temperature range, a blank cut beforehand from a strip of steel whose composition is typical of that of steels having a multiphase microstructure, which at the start does not necessarily possess a multiphase structure, in order to form a steel part that acquires a multiphase microstructure upon being cooled between the forming tools. The inventors have also demonstrated that, provided that the cooling rate is high enough, a homogeneous multiphase microstructure can be obtained whatever the rate of cooling of the blank between the tools.

The benefit of this invention lies in the fact that there is no need for the multiphase microstructure to have been formed during the stage of manufacturing the hot-rolled sheet or its coating and that the fact of forming said microstructure at the stage of manufacturing the part, by hot-forming, makes it possible to guarantee that the final multiphase microstructure is homogeneous in each of the regions of the part. This is advantageous in the case of its use for energy-absorbing parts, since the microstructure is not altered as is the case when parts made of dual-phase steel or TRIP steel are cold-formed.

The inventors have in fact confirmed that the energy absorption capability of a part, determined by the tensile strength multiplied by the elongation ($R_m \times A$), is higher when the part has been obtained according to the invention than when it has been obtained by cold-forming a blank made of dual-phase steel or TRIP steel. This is because the cold-forming operation consumes some of the energy absorption capability.

Furthermore, by carrying out a hot-forming operation, the springback of the part becomes negligible, whereas it is very large in the case of a cold-forming operation. It is also larger the higher the tensile strength $R_m$. This puts a brake on the use of very-high strength steels.

Another advantage of the invention lies in the fact that the hot-forming operation results in appreciably higher formability than with cold-forming. Thus it is possible to obtain a wider variety of shapes and envision new designs of parts while still maintaining steel compositions whose characteristics, such as, for example weldability, are known.

The part obtained has a multiphase microstructure comprising ferrite preferably with a content equal to or greater than 25% by area, and at least one of the following phases: martensite, bainite, residual austenite. This is because a ferrite content of at least 25% by area gives the steel sufficient ductility for the formed parts to have a high energy absorption capability.

A steel blank intended to be formed, for example by deep-drawing, is cut beforehand either from a hot-rolled steel strip or from a cold-rolled steel strip, the steel consisting of the following elements:

carbon with a content between 0.01 and 0.50% by weight. This element is essential for obtaining good mechanical properties, but it must not be present in too large an amount in order not to impair the weldability. To promote hardenability and to obtain a sufficient yield strength $R_e$, the carbon content must be equal to or greater than 0.01% by weight;

manganese with a content of between 0.50 and 3.0% by weight. Manganese promotes hardenability, thereby enabling a high yield strength $R_e$ to be achieved. However, it is necessary for the steel not to comprise too much manganese, so as to avoid segregation which can be demonstrated in the heat treatments that will be mentioned later in the description. Furthermore, excess manganese prevents flash welding if the amount of silicon is insufficient, and the ability of the steel to be galvanized is impaired. Manganese also plays a role in the interdiffusion of iron and aluminum in the case in which the steel is coated with aluminum or an aluminum alloy;

silicon with a content between 0.001 and 3.0% by weight. Silicon improves the yield strength $R_e$ of the steel. However, above 3.0% by weight, hot-dip galvanizing of the steel becomes difficult and the appearance of the zinc coating is unsatisfactory;

aluminum with a content between 0.005 and 3.0% by weight. Aluminum stabilizes the ferrite. Its content must remain below 3.0% by weight in order to avoid degrading the weldability due to the presence of aluminum oxide in the weld zone. However, a minimum amount of aluminum is required to deoxidize the steel;

molybdenum with a content equal to or less than 1.0% by weight. Molybdenum promotes the formation of martensite and increases the corrosion resistance. However, excess molybdenum may promote the phenomenon of cold cracking in the weld zones and reduce the toughness of the steel;

chromium with a content equal to or less than 1.5% by weight. The chromium content must be limited so as to avoid surface appearance problems in the case of galvanizing the steel;

phosphorus with a content equal to or less than 0.10% by weight. Phosphorus is added so as to allow the amount of carbon to be reduced and to improve the weldability, while still having an equivalent level of yield strength $R_e$ of the steel. However, above 0.10% by weight, it embrittles the steel because of the increased risk of segregation defects, and the weldability deteriorates;

titanium with a content equal to or less than 0.20% by weight. Titanium improves the yield strength R, however, its content must be limited to 0.20% by weight in order to avoid degrading the toughness;

vanadium with a content equal to or less than 1.0% by weight. Vanadium improves the yield strength $R_e$ by grain refining and promotes weldability of the steel. However, above 1.0% by weight, the toughness of the steel deteriorates and there is a risk of cracks appearing in the weld zones;

optionally, nickel with a content equal to or less than 2.0% by weight. Nickel increases the yield strength $R_e$. In general, its content is limited to 2.0% by weight because of its high cost;

optionally, copper with a content equal to or less than 2.0% by weight. Copper increases the yield strength $R_e$, however, excess copper promotes the appearance of cracks during hot rolling and degrades the hot formability of the steel;

optionally, sulfur with a content equal to or less than 0.05% by weight. Sulfur is a segregating element, the content of which must be limited so as to avoid cracks during hot rolling; and optionally, niobium with a content equal to or less than 0.15% by weight. Niobium promotes the precipitation of carbonitrides, thereby increasing the yield strength $R_e$. However, above 0.15% by weight, the weldability and hot formability are degraded.

The balance of the composition consists of iron and other elements that are usually expected to be found as impurities resulting from the smelting of the steel, in proportions that do not affect the desired properties.

In general, before they are cut into blanks, the steel strips are corrosion-protected by a metal coating. Depending on the end use of the part, this metal coating is chosen from zinc or zinc-alloy (for example zinc-aluminum) coatings and, if good heat resistance is also desired, aluminum or aluminum alloy (for example aluminum-silicon) coatings. These coatings are deposited conventionally, either by hot-dip coating in a bath of liquid metal, or by electrodeposition, or by vacuum coating.

To implement the manufacturing process according to the invention, the steel blank is heated so as to raise it to a soak temperature $T_s$ above Ac1 but below Ac3 and is maintained at this temperature $T_s$ for a soak time $t_s$ which is adjusted so that the steel, after the blank has been heated, has an austenite content equal to or greater than 25% by area.

Immediately after this operation of heating the steel blank and keeping it at temperature, said heated blank is transferred into a forming tool in order to form a part and is cooled therein. The cooling of the part within the forming tool is carried out at a cooling rate V high enough to prevent all the austenite from being transformed to ferrite and so that the microstructure of the steel after the part has been cooled is a multiphase microstructure comprising ferrite, which microstructure is homogeneous in each of the regions of the part.

The expression "multiphase microstructure homogeneous in each of the regions of the part" is understood to mean a microstructure which is constant in terms of contents and morphology in each of the regions of the part, and in which the various phases are uniformly distributed.

In order for the cooling rates V to be high enough, the forming tools may be cooled for example by circulation of a fluid.

Furthermore, the clamping force of the forming tool must be sufficient to ensure intimate contact between the blank and the tool and to ensure effective and homogeneous cooling of the part.

Optionally, after the blank has been cut from the steel strip and before the blank is heated, it may optionally undergo prior cold deformation.

Prior cold deformation of the blank, for example by cold-forming or light drawing of the blank, before the hot-forming operation is advantageous insofar as it allows parts to be obtained that may have a more complex geometry.

Moreover, to obtain certain geometries in a single forming operation is possible only if two blanks are butt-welded together. A prior cold deformation may thus allow a part to be obtained as a single piece, that is to say a part obtained by the forming of a single blank.

In a first preferred implementation of the invention, the process according to the invention is carried out in order to manufacture a part made of steel having a multiphase microstructure comprising either ferrite and martensite or ferrite and bainite, or else ferrite, martensite and bainite.

To form this microstructure, the aforementioned multiphase composition, in particular the carbon, silicon and aluminum contents, of the steel are adapted. Thus, the steel comprises the following elements:

carbon with a content preferably between 0.01 and 0.25%, more preferably between 0.08 and 0.15%, by weight. The carbon content is limited to 0.25% by weight so as to limit the formation of martensite and thus prevent the ductility and formability from deteriorating;

manganese with a content preferably between 0.50 and 2.50% by weight and more preferably between 1.20 and 2.00% by weight;

silicon with a content preferably between 0.01 and 2.0% by weight and more preferably between 0.01 and 0.50% by weight;

aluminum with a content preferably between 0.005 and 1.5% by weight and more preferably between 0.005 and 1.0% by weight. It is preferable for the aluminum content to be less than 1.5% by weight so as to avoid degrading the flash weldability due to the formation of aluminum oxide $Al_2O_3$ inclusions;

molybdenum with a content preferably between 0.001 and 0.50% by weight and more preferably between 0.001 and 0.10% by weight;

chromium with a content preferably equal to or less than 1.0% by weight and more preferably equal to or less than 0.50% by weight;

phosphorus with a content preferably equal to or less than 0.10% by weight;

titanium with a content preferably equal to or less than 0.15% by weight;

niobium with a content preferably equal to or less than 0.15% by weight; and vanadium with a content preferably equal to or less than 0.25% by weight.

The balance of the composition consists of iron and other elements that are usually expected to be found as impurities resulting from the smelting of the steel, in contents that do not affect the desired properties.

To form a part made of multiphase steel comprising ferrite and martensite and/or bainite according to the invention, the blank is heated to a soak temperature $T_s$ above Ac1 but below Ac3 so as to control the content of austenite formed during heating of the blank and not to exceed the preferred upper limit of 75% austenite by area.

An austenite content in the steel heated at a soak temperature $T_s$ for a soak time $t_s$ of between 25 and 75% by area offers a good compromise in terms of tensile strength of the steel after forming and uniformity of the mechanical properties of the steel thanks to the robustness of the process. This is because above 25% austenite by area, hardening phases, such as for example martensite and/or bainite, are formed in sufficient quantity during the cooling of the steel for the yield strength $R_e$ of the steel after forming to be sufficient. However, above 75% austenite by area, it is difficult to control the austenite content in the steel and there is a risk of forming an excess amount of hardening phases during cooling of the steel and consequently of forming a steel part having an insufficient elongation at break A, thereby impairing the energy absorption capability of the part.

The soak time of the steel blank at the soak temperature $T_s$ essentially depends on the thickness of the strip. Within the context of the present invention, the thickness of the strip is typically between 0.3 and 3 mm. Consequently, to form an austenite content between 25 and 75% by area, the soak time $t_s$ is preferably between 10 and 1000 s. If the steel blank is held at a soak temperature $T_s$ for a soak time $t_s$ longer than 1000 s, the austenite grains coarsen and the yield strength $R_e$ of the steel after forming will be limited. Furthermore, the hardenability of the steel is reduced and the surface of the steel oxidizes. However, if the blank is held for a soak time $t_s$ shorter than 10 s, the content of austenite formed will be insufficient and the content of martensite and/or bainite formed during the in-tool cooling of the part will be insufficient for the yield strength $R_e$ of the steel to be high enough.

The cooling rate V of the steel part in the forming tool depends on the deformation and on the quality of the contact between the tool and the steel blank. However, the cooling rate V must be high enough for the desired multiphase microstructure to be obtained, and is preferably greater than 10° C./s. For a cooling rate V equal to or less than 10° C./s, there is a risk of forming carbides that will contribute to degrading the mechanical properties of the part.

Under these conditions, what is formed after cooling is a part made of multiphase steel comprising more than 25% ferrite by area, the balance being martensite and/or bainite, and the various phases being homogeneously distributed in each of the regions of the part. In a preferred implementation of the invention, 25 to 75% ferrite by area and 25 to 75% martensite and/or bainite by area are formed.

In a second preferred implementation of the invention, the process according to the invention is used to manufacture a part made of TRIP steel. Within the context of the invention, the term "TRIP steel" is understood to mean one having a multiphase microstructure comprising ferrite, residual austenite and optionally martensite and/or bainite.

To form this TRIP multiphase microstructure, the above-mentioned composition and in particular the carbon, silicon and aluminum contents of the multiphase steel are adapted. Thus, the steel comprises the following elements:

carbon with a content preferably between 0.05 and 0.50% by weight and more preferably between 0.10 and 0.30% by weight. To form stabilized residual austenite, it is preferable for this element to be present with a content equal to or greater than 0.05% by weight, this is because carbon plays a very important role in the formation of the microstructure and of the mechanical properties: according to the invention, a bainite transformation takes place starting from an austenitic structure formed at high temperature, and bainitic ferrite laths are formed. Because of the very low solubility of carbon in ferrite compared with austenite, the carbon of the austenite is rejected between the laths. Thanks to certain alloying elements of the steel composition according to the invention, in particular silicon and manganese, carbide, especially cementite, precipitation occurs very little. Thus, the inter-lath austenite becomes progressively enriches with carbon without the precipitation of carbides occurring. This enrichment is such that the austenite is stabilized, that is to say the martensite transformation of this austenite does not take place during cooling down to room temperature;

manganese with a content preferably between 0.50 and 3.0% by weight and more preferably between 0.60 and 2.0% by weight. Manganese promotes the formation of austenite and helps to lower the martensite transformation start temperature Ms and to stabilize the austenite. This addition of manganese also contributes to effective solid-solution hardening and therefore to a high yield strength $R_e$ being achieved. However, since an excess of manganese prevents sufficient ferrite being formed during cooling, the carbon concentration in the residual austenite is insufficient for it to be stable. The manganese content is more preferably between 0.60 and 2.0% by weight. In this way, the above-desired effects are obtained without the risk of forming a deleterious banded structure that would result from any segregation of manganese during solidification;

silicon with a content preferably between 0.001 and 3.0% by weight and more preferably between 0.01 and 2.0% by weight. Silicon stabilizes the ferrite and stabilizes the residual austenite at room temperature. Silicon inhibits the precipitation of cementite from austenite during cooling, by considerably reducing the growth of carbides. This stems from the fact that the solubility of silicon in cementite is very low and that this element increases the activity of carbon in the austenite. Consequently, any cementite seed forming will be surrounded by a silicon-rich austenitic zone that will have been rejected at the precipitate/matrix interface. This silicon-enriched austenite is also richer in carbon, and the growth of cementite is slowed down because of lower diffusion resulting from the reduced carbon gradient between the cementite and the neighboring austenitic zone. This addition of silicon helps to stabilize a sufficient amount of residual austenite to obtain a TRIP effect. This addition of silicon also helps to increase the yield strength $R_e$ thanks to solid-solution hardening. However, an excessive addition of silicon causes the formation of highly adherent oxides, which are difficult to remove during a pickling operation, and the possible appearance of surface defects due in particular to a lack of wettability in the hot-dip galvanizing operations. To stabilize a sufficient amount of austenite while still reducing the risk of surface defects, the silicon content is preferably between 0.01 and 2.0% by weight;

aluminum with a content preferably between 0.005 and 3.0% by weight. Like silicon, aluminum stabilizes the ferrite and increases the formation of ferrite during cooling of the blank. It has a very low solubility in the cementite and may be used for this purpose to prevent the cementite from precipitating during a soak at a bainite transformation temperature and to stabilize the residual austenite;

molybdenum with a content preferably equal to or less than 1.0% by weight and more preferably equal to or less than 0.60% by weight;

chromium with a content preferably equal to or less than 1.50% by weight. The chromium content is limited so as to avoid surface appearance problems in the case of galvanizing the steel;

nickel with a content preferably equal to or less than 2.0% by weight;

copper with a content equal to or less than 2.0% by weight;

phosphorus with a content preferably equal to or less than 0.10% by weight. Phosphorus in combination with silicon increases the stability of the residual austenite by suppressing the precipitation of carbides;

sulfur with a content preferably equal to or less than 0.05% by weight;

titanium with a content preferably equal to or less than 0.20% by weight; and vanadium with a content preferably equal to or less than 1.0% by weight and more preferably equal to or less than 0.60% by weight.

The balance of the composition consists of iron and other elements that are usually expected to be found as impurities resulting from the smelting of the steel, in contents that do not affect the desired properties.

The soak time of the steel blank at a soak temperature $T_s$ above Ac1 but below Ac3 essentially depends on the thickness of the strip. Within the context of the present invention, the thickness of the strip is typically between 0.3 and 3 mm.

Consequently, to form an austenite content equal to or greater than 25% by area, the soak time $t_s$ is preferably between 10 and 1000 s. If the steel blank is held at a soak temperature $T_s$ for a soak time $t_s$ longer than 1000 s, the austenite grains coarsen and the yield strength $R_e$ of the steel after forming will be limited. Furthermore, the hardenability of the steel is reduced and the surface of the steel oxidizes. However, if the blank is held for a soak time $t_s$ shorter than 10 s, the content of austenite formed will be insufficient and residual austenite and bainite will not form sufficiently during in-tool cooling of the part.

The cooling rate V of the steel part in the forming tool depends on the deformation and the quality of the contact between the tool and the steel blank. To obtain a part made of steel having a TRIP multiphase microstructure, it is preferable for the cooling rate V to be between 10° C./s and 200° C./s. This is because below 10° C./s essentially ferrite and carbides will form, but insufficient residual austenite and martensite, while above 200° C./s essentially martensite will form with insufficient residual austenite.

It is essential to form austenite with a content equal to or greater than 25% by area during the heating of the blank so that, upon cooling the steel in the forming tool, sufficient residual austenite remains and the desired TRIP effect can thus be obtained.

Under these conditions, what is obtained after cooling is a part made of multiphase steel consisting, in % by area, of ferrite with a content equal to or greater than 25%, of 3 to 30% residual austenite and optionally of martensite and/or bainite.

The TRIP effect may advantageously be put to good use for absorbing the energy in the event of a high-speed impact. This is because during a large deformation of a TRIP steel part, the residual austenite progressively transforms to martensite, while selecting the orientation of the martensite. This has the effect of reducing the residual stresses in the martensite, to reduce the internal stresses in the part and finally to limit damage of the part, since the latter will fracture at a higher elongation A if it were not made of a TRIP steel.

The invention will now be illustrated by examples given by way of indication but implying no limitation, with reference to the single appended FIGURE, which is a photograph of a part obtained by cold-forming (reference G) and of a part obtained by hot-forming (reference A).

The inventors carried out trials both on steels having, on the one hand, a composition typical of that of steels having a multiphase multistructure comprising ferrite and martensite and/or bainite (point 1) and, on the other hand, a composition typical of that of steels having TRIP multiphase microstructure (point 2).

1—Steel with a Composition Typical of that of Steels having a Multiphase Microstructure Comprising Ferrite and Martensite 1.1 Evaluation of the Influence of the Heating and Cooling Rates Blanks measuring 400×600 mm were cut from a strip of steel, the composition of which, given in Table I, is that of a steel of DP780 (Dual Phase 780) grade. The strip had a thickness of 1.2 mm. The Ac1 temperature of the steel was 705° C. and the Ac3 temperature was 815° C. The blanks were heated to a variable soak temperature $T_s$ and held there for a soak time of 5 min. They were then immediately transferred to a deep-drawing tool in which they were both formed and cooled at variable cooling rates V, keeping them in the tool for a time of 60 s. The deep-drawn parts had a structure similar to the shape of an omega.

After the parts were completely cooled, their yield strength $R_e$, their tensile strength $R_m$ and their elongation at break A were measured and the microstructure of the steel was determined. As regards the microstructure, F denotes ferrite, M denotes martensite and B denotes bainite. The results are given in Table II.

TABLE I

Chemical composition of the steel according to the invention, expressed in % by weight, the balance being iron or impurities.

| C | Mn | Si | Al | Mo | Cr | P | Ti | Nb | V |
|---|---|---|---|---|---|---|---|---|---|
| 0.15 | 1.91 | 0.21 | 0.37 | 0.005 | 0.19 | 0.01 | 0.03 | 0.001 | — |

TABLE II

Mechanical properties and microstructure of the deep-drawn parts

| $T_s$ (° C.) | V (° C./s) | Part | $R_e$ (MPa) | $R_m$ (MPa | A (%) | $R_m \times A$ | Microstructure (% by area) |
|---|---|---|---|---|---|---|---|
| *800 | 10 | A | 354 | 803 | 18.2 | 14615 | 86% F + 14% M |
| | 35 | B | 502 | 982 | 13.8 | 13552 | 72% F + 28% M |
| | 100 | C | 530 | 1046 | 13.3 | 13912 | 55% F + 5% B + 40% M |
| 900 | 10 | D | 441 | 723 | 14.3 | 10339 | 50% F + 42% B + 8% M |
| | 35 | E | 724 | 1100 | 8 | 8800 | 90% B + 10% M |
| | 100 | F | 890 | 1285 | 4.6 | 5911 | 100% M |

*according to the invention.

The results of this trial clearly show that only by heating the steel to a temperature between Ac1 and Ac3 is it possible to obtain a multiphase microstructure comprising ferrite, whatever the cooling rate of the steel in the forming tool. This is because when the steel is heated at a temperature above Ac3, it is then necessary for the cooling rate V to be strictly controlled during forming, so as to obtain a steel having a multiphase microstructure comprising more than 25% ferrite by area, and preferably between 25% and 75% ferrite by area.

In addition to a small variation in the mechanical properties according to the cooling rate for the parts as claimed according to the invention, their energy absorption capability is superior to that of parts obtained with heating at a temperature above Ac3.

1.2 Evaluation of the Springback

The purpose of this trial was to show the benefit of hot-forming compared with cold-forming, and to evaluate the springback.

For this purpose, a part made of DP780 grade steel was manufactured by cold deep-drawing a blank cut from a steel strip 1.2 mm in thickness, the composition of the steel being indicated in Table I but which, unlike the strip used in point 1, already had, before deep-drawing, a multiphase microstructure comprising 70% ferrite by area, 15% martensite by area and 15% bainite by area. FIG. 1 clearly shows that the part formed by cold deep-drawing (indicated in the FIGURE by the letter G) has a high springback compared with the part A (see Table II) formed by hot deep-drawing (identified by the letter A).

2—Steel with a Composition Typical of that of Trip Steels

Blanks measuring 200×500 mm were cut from a strip of steel the composition of which, indicated in Table III, was that of a steel of TRIP 800 grade. The strip had a thickness of 1.2 mm. The Ac1 temperature of this steel was 751° C. and the Ac3 temperature was 875° C. The blanks were heated at a variable soak temperature $T_s$ for a soak time of 5 min and then immediately transferred to a deep-drawing tool in which they were both formed and cooled with a cooling rate V of 45° C./s, holding them in the tool for a time of 60 s. The deep-drawn parts had a structure similar to that of an omega shape.

After the parts had been completely cooled, their yield strength $R_e$ their tensile strength $R_m$ and their elongation at break A were measured and the microstructure of the steel was determined. As regards the microstructure, F denotes ferrite, A denotes residual austenite, M denotes martensite and B denotes bainite. The results are given in Table IV.

TABLE III

Chemical composition of the steel according to the invention, expressed in % by weight, the balance being iron or impurities

| C | Mn | Si | Al | Mo | Cr | P | Ti | Nb | V |
|---|---|---|---|---|---|---|---|---|---|
| 0.2 | 1.5 | 1.5 | 0.05 | 0.007 | 0.01 | 0.011 | 0.005 | — | — |

TABLE IV

Mechanical properties and microstructure of the deep-drawn parts

| $T_s$ (° C.) | Part | $R_e$ (MPa) | $R_m$ (MPa | A (%) | $R_m \times A$ | Microstructure (% by area) |
|---|---|---|---|---|---|---|
| *760 | H | 541 | 1174 | 12.4 | 14558 | 35% F + 17% A + 48% M |
| *800 | I | 485 | 1171 | 12.8 | 14989 | 45% F + 11% A + 44% M |
| *840 | J | 454 | 1110 | 14.3 | 15873 | 45% F + 15% A + 38% M + 2% B |

*according to the invention.

The trials carried out clearly show that by deep-drawing the blanks produced according to the invention it is possible to obtain parts having very high mechanical properties and also a small variation in the mechanical properties whatever the cooling temperature.

The invention claimed is:

1. A hot deep drawn part made of steel having a homogeneous multiphase microstructure throughout said part, said microstructure comprising ferrite, wherein the part made of steel is obtained by a process comprising:

cutting a blank from a strip of steel, the composition of which comprises, in % by weight:

0.01≤C≤0.50%
0.50≤Mn≤3.0%
0.001≤Si≤3.0%
0.005≤Al≤3.0%
Mo≤1.0%
Cr≤1.5%
P≤0.10%
Ti≤0.20%
V≤1.0% and the balance of the composition being iron and impurities resulting from the smelting;

said blank is heated so as to reach a soak temperature $T_s$ above Ac1 but below Ac3 and held at this soak temperature $T_s$ for a soak time $t_s$ adjusted so that the steel, after the blank has been heated, has an austenite content equal to or greater than 25% by area;

said heated blank is transferred into a deep drawing tool so as to hot-deep draw said part; and the part is cooled within the tool at a cooling rate V such that the microstructure of the steel, after the part has been cooled, is a multiphase microstructure, said microstructure comprising ferrite and being homogeneous throughout said part.

2. The part as claimed in claim 1, wherein the microstructure of the steel, after the part has been cooled, is a multiphase microstructure with a ferrite content equal to or greater than 25% by area.

3. The part as claimed in claim 1, wherein the composition of the steel comprises, in % by weight:

0.01≤C≤0.25%
0.50≤Mn≤2.50%
0.01≤Si≤2.0%
0.005≤Al≤1.5%
0.001≤Mo≤0.50%
Cr≤1.0%
P≤0.10%
Ti≤0.15%
Nb≤0.15%
V≤0.25%, the balance of the composition being iron and impurities resulting from the smelting; the blank is held at the soak temperature $T_s$ for a soak time $t_s$ adjusted so that the steel, after heating, has an austenite content between 25 and 75% by area; and the microstructure of the steel, after the part has been cooled, is a multiphase microstructure comprising ferrite and either martensite, or bainite, or both martensite and bainite.

4. The part as claimed in claim 3, wherein the steel comprises, in % by weight:

0.08≤C≤0.15%
1.20≤Mn≤2.00%
0.01≤Si≤0.50%
0.005≤Al≤1.0%
0.001≤Mo≤0.10%
Cr≤0.50%
P≤0.10%
Ti≤0.15%
Nb≤0.15%
V≤0.25%, the balance of the composition being iron and impurities resulting from the smelting.

5. The part as claimed in claim 3, wherein the soak time $t_s$ is between 10 and 1000 s.

6. The part as claimed in claim 3, wherein the cooling rate V is greater than 10° C./s.

7. The part as claimed in claim 3, wherein the multiphase structure of the steel, after said part has been cooled, comprises 25 to 75% ferrite by area and 25 to 75% martensite and/or bainite by area.

8. The part as claimed in claim 1, wherein the steel comprises, in % by weight:

0.05≤C≤0.50%
0.50≤Mn≤3.0%
0.001 <Si <3.0%
0.005 <Al <3.0%
Mo≤1.0%
Cr≤1.50%
Ni≤2.0%
Cu≤2.0%
P ≤0.10%
S≤0.05%
Ti≤0.20%
V≤1.0%, the balance of the composition being iron and impurities resulting from the smelting; the microstructure of the steel, after the part has been cooled, is a TRIP multiphase microstructure comprising ferrite, residual austenite and optionally martensite and/or bainite.

9. The part as claimed in claim 8, wherein the steel comprises, in % by weight:

0.10≤C≤0.30%
0.60≤Mn≤2.0%
0.01≤Si≤2.0%
0.005≤Al≤3.0%
Mo≤0.60%
Cr≤1.50%
Ni≤0.20%
Cu≤0.20%
P≤0.10%
S≤0.05%
Ti≤0.20%
V≤0.60%, the balance of the composition being iron and impurities resulting from the smelting.

10. The part as claimed in claim 8, wherein the soak time $t_s$ is between 10 and 1000 s.

11. The part as claimed in claim 8, wherein the cooling rate V is between 10 and 200° C./s.

12. The part as claimed in claim 8, wherein, after the part has been cooled, the multiphase microstructure of the TRIP steel consists, in % by area, of ferrite with a content equal to or greater than 25%, of 3 to 30% residual austenite and optionally of martensite and/or bainite.

13. The process as claimed in claim 1, wherein the steel strip is coated beforehand with a metal coating, before being cut to form a blank.

14. The process as claimed in claim 13, wherein the metal coating is a coating based on zinc or a zinc alloy.

15. The process as claimed in claim 13, wherein the metal coating is a coating based on aluminum or an aluminum alloy.

16. A land motor vehicle comprising the steel part as claimed in claim 1.

17. The part as claimed in claim 1, wherein the steel comprises, in % by weight, at least one of the elements selected from:

Ni≤2.0%,
Cu≤2.0%,
S≤0.05%,
Nb≤0.15%.

18. The part as claimed in claim 1, wherein the blank was subject to cold deformation.

19. The part as claimed in claim 1, wherein a dispersion in the tensile strength Rm within a cooling rate range varying from 10 to 100° C./s is less than 25%.

20. The part as claimed in claim 1, wherein the cooling rate is from 10° C./s to 200° C./s.

21. The part as claimed in claim 1, wherein the microstructures include martensite and residual austenite.

22. The part as claimed in claim 1, wherein the microstructures include from 3 to 30% residual austenite.

23. The part as recited in claim 1, wherein the part is a TRIP steel.

24. The part as claimed in claim 1, wherein the microstructures include from 0 to 48% martensite.

25. The part as claimed in claim 1, wherein the microstructures include from 0 to 5% bainite.

* * * * *